United States Patent [19]

Koslover et al.

[11] Patent Number: 4,999,591

[45] Date of Patent: Mar. 12, 1991

[54] CIRCULAR $TM_{01}$ TO $TE_{11}$ WAVEGUIDE MODE CONVERTER

[75] Inventors: Robert A. Koslover; Charles D. Cremer, both of Albuquerque, N. Mex.; William P. Geren, Seattle, Wash.; Donald E. Voss, Cedar Crest; Lynn M. Miner, Albuquerque, both of N. Mex.

[73] Assignee: The United States of America as represented by the Secretary of the Air Force, Washington, D.C.

[21] Appl. No.: 491,379

[22] Filed: Feb. 22, 1990

[51] Int. Cl.[5] ..... H01P 1/16

[52] U.S. Cl. ..... 333/21 R; 333/251

[58] Field of Search ..... 333/21 R, 21 A, 34, 333/242, 248, 251

[56] References Cited

U.S. PATENT DOCUMENTS

| | | | |
|---|---|---|---|
| 2,129,669 | 9/1938 | Bowen | 333/21 R |
| 2,546,840 | 3/1951 | Tyrrell | 333/21 A X |
| 2,816,271 | 12/1957 | Barker | 333/13 |
| 3,566,309 | 2/1971 | Ajioka | 333/21 R X |
| 3,896,449 | 7/1975 | Blume | 343/786 |
| 3,955,202 | 5/1976 | Young | 343/756 |
| 4,510,469 | 4/1985 | Bowman | 333/21 R |
| 4,516,088 | 5/1985 | Johnson et al. | 333/248 X |

OTHER PUBLICATIONS

New Compact Broadband High-Efficiency Mode Converters For High Power Microwave Tubes With $TE_{On}$ or $TM_{On}$ Mode Outputs, M. J. Buckley, G. H. Luo and R. J. Vernon, University of Wisconsin, Madison, Wis. 53706-1691, pp. 797-800.

Microwave Transmission Circuits, George L. Ragan, General Electric Co. Research Lab., First Edition, pp. 379-405.

*Primary Examiner*—Paul Gensler

*Attorney, Agent, or Firm*—Gerald B. Hollins; Donald J. Singer

[57] ABSTRACT

A waveguide mode converting apparatus especially of the $TM_{01}$ to $TE_{11}$ converting type and usable in circuit waveguide apparatus with desirable high efficiency and relatively small physical size is disclosed. The mode converter employs the combination of an asymmetrically shaped conical frustum waveguide segment together with a radially disposed fin having tapered input and output or ramp surfaces. Details of a 1.3 gigahertz embodiment of the mode converter including dimensions are included along with the results of efficiency measuring and indications of alternate arrangements of the invention.

20 Claims, 4 Drawing Sheets

CIRCULAR $TM_{01}$ TO $TE_{11}$ WAVEGUIDE MODE CONVERTER

RIGHTS OF THE GOVERNMENT

The invention described herein may be manufactured and used by or for the government of the United States for all governmental purposes without the payment of any royalty.

BACKGROUND OF THE INVENTION

This invention relates to the field of microwave radio frequency waveguide devices and to the conversion between selected transverse magnetic and traverse electric operating modes in such waveguide.

In the design of radio frequency apparatus which operates in the ultra high and microwave range of frequencies it is often necessary to consider configurations of the electric and magnetic fields which exist inside waveguide elements communicating signals between portions of the apparatus. The configuration of these electric and magnetic fields is determined by boundary conditions imposed by the waveguide walls and by the constraints of Maxwell's equations which require that there be no tangential components of electric field and no normal component of magnetic field existing at the waveguide walls. Usually a plurality of independent field configurations can meet these constraints in a particular waveguide disposal. Each of these field configurations is referred to as a waveguide operating mode or more simply as a mode. Knowledge of these modes in a radio frequency energy generating and utilizing apparatus is often essential in order to achieve any functional operation or efficient operation of the apparatus. In the virtual cathode microwave oscillator (VCO), for example, electromagnetic energy is usually generated in one or more $TM_{0n}$ modes in a circular waveguide, however, utilization of this energy in a conical antenna element is inconvenient or impractical primarily because of the null on axis antenna pattern which results from feeding an antenna with energy in this mode. Conversion of $TM_{0n}$ mode energy to the $TE_{11}$ mode is a desirable addition to this combination since a peaked on axis antenna beam can thereby be achieved.

Background discussions of waveguide modes are to be found in the textbooks "Antenna Engineering" authored by R. C. Johnson and H. Jasik 2nd edition, McGraw-Hill Incorporated, 1984 especially in chapter 42, and in "Electronic and Radio Engineering" authored by Frederic E. Terman, McGraw-Hill Incorporated, 1955 especially in chapter 5 and in "Principles and Applications of Waveguide Transmission" authored by George C. Southworth, D. Van Nostrand Company Incorporated, 1950 all of which are hereby incorporated by reference herein. The footnotes to chapter 5 in the Terman textbook identifies some of the earliest work in the use of waveguides and transmission systems for very high frequency electrical signals. Each of these textbooks illustrate the magnetic and electric field patterns comprising the $TM_{01}$ and $TE_{11}$ circular waveguide modes.

In topics of present technical endeavor, both the performance of High Power Microwave (HPM) susceptibility testing and the development of compact HPM sources for use as directed energy weapons require the availability of HPM sources and systems that are compatible with antennas in order to produce radiation in a forward-directed centrally-peaked pattern.

Some of the highest peak power HPM sources reported to date (e.g., VCOs and related sources) however, produce microwave energy in the $TM_{01}$ mode in circular waveguide. The production of microwave energy in the $TM_{01}$ mode is, in fact, a fundamental consequence of the physical processes by which such devices operate.

As a result of these and other needs in the art there have been a number of methods employed to convert microwave energy in the $TM_{01}$ mode to the $TE_{11}$ mode, however each of these methods have several disadvantages, and thus have not found widespread application. Earlier $TM_{01}$ to $TE_{11}$ mode conversion methods include, for example:

1. Simple waveguide bends: a typical waveguide bend-type converter is described in U.S. Air Force Weapons Laboratory Technical Report AFWL-TR-88-31 "Low-Frequency High-Power Microwave Source Development" which was authored by M. D. Haworth et al, February 1989. Copies of this report may be obtained by selected persons from the Commander of the U.S. Air Force Weapons Laboratory, Kirtland Air Force Base, New Mexico. Although this converter is capable of broadband operation at very high power levels, it cannot exceed a theoretical maximum of 62.5% efficiency, is bulky and heavy, difficult to machine, and produces radiation at an inconvenient angle to the source axis.

2. Serpentine waveguide bends: A serpentine waveguide bend-type converter is described by M. J. Buckley, G. H. Luo, and R. J. Vernon, in "New Compact High-Efficiency Mode Converters for High Power Microwave Tubes with $TE_{0n}$ or $TM_{0n}$ Mode Outputs," 1988 IEEE MTT-S Digest, p 797–800. The serpentine waveguide design for a $TM_{01}$ to $TE_{11}$ mode converter described in this report is, in fact, capable of operation at very high power levels and at extremely high efficiency (98%), but is bulky and heavy, very difficult to machine, and is only efficient over a narrow frequency band.

3. Rotary joint converters: A waveguide rotary joint converter is described by G. L. Ragan, in "Microwave Transmission Circuits" in Volume 9 of the Radiation Laboratory Series, McGraw Hill 1948. This converter is actually a rectangular $TE_{10}$ to $TM_{01}$ and back to rectangular $TE_{10}$ converter originally designed to allow two rectangular waveguides to be joined in a rotatable joint. By use of only half of the joint, one may convert a circular $TM_{01}$ mode to a rectangular $TE_{10}$ mode. Microwave power in the rectangular $TE_{10}$ mode may be radiated as an on-axis pencil beam from a pyramidal horn, in principle achieving the same advantages as conversion to the circular $TE_{11}$ mode. The rotary joint converter is not generally used with HPM sources, however, since it utilizes a resonantly tuned shorting plate and is therefore highly efficient only over a very narrow frequency band.

Prior patents have also considered the subject of microwave mode conversion and other uses of apparatus having structural similarities to mode converter devices. The U.S. Pat. No. of J. Barker, 2,816,271, for example, discloses a microwave mode converter in which a gas filled thin fin member is disposed in a circular waveguide in order that the waveguide have altered characteristics at differing levels of input energy. Additionally U.S. Pat. No. 3,896,449 issued A. E. Blume, describes a horn antenna arrangement which includes higher order mode compensating provisions including the use of flared or conical frustum waveguide sections.

U.S. Pat. No. 3,955,202, issued to P. T. K. Young, additionally shows the use of tapered wedge members within a circular or rectangular waveguide in order to generate the desired polarization of signals entering a horn antenna element. Additionally the U.S. Pat. No. 4,510,469 of D. F. Bowman discloses the use of shaped dielectric members in combination with tapered waveguide sections in order to achieve mode conversion. Additional background information somewhat relevant to the present invention is to be found in a number of published textbook references including the above mentioned Radiation Laboratory Series of texts published by McGraw Hill Book Company particularly in chapter 6 of volume 9 and especially in section 6.23 of this chapter 6. Additionally the text "Field and Wave Electrodynamics" by C. C. Johnson also published by McGraw Hill in 1965 and particularly sections 4.12–4.17 therein provide interesting background and somewhat relevant prior art with regard to the present invention.

The subject of broadband high efficiency mode converters is also treated in the article "New Compact Broadband High-Efficiency Mode Converter for High Power Microwave Tubes With $TE_{0n}$ or $TM_{0n}$ Mode Outputs" authored by M. J. Buckley et al which appears in the 1988 Institute of Electrical and Electronic Engineers microwave theory digest at page 797.

Although each of these examples of prior work in the field of mode converters is of interest with respect to the present invention, none of these efforts have achieved the benefits of a compact broadband high power circular $TM_{01}$ to $TE_{11}$ waveguide mode converter nor used the combination of waveguide structure disclosed in the present invention.

SUMMARY OF THE INVENTION

In the present invention a mode converter of compact size and offset axis aligned physical disposition, broadband electrical characteristics, and high power operating capability is provided. Mode conversion in the invention is achieved with the combination of a radially oriented fin and a tapering conical frustum waveguide section with the conical frustum section being of a nonsymmetric or asymmetric type wherein the axis of the input and output ports are laterally displaced. The invention is disclosed to achieve $TM_{01}$ to $TE_{11}$ conversion with notable high mode conversion efficiency in combination with relatively broadband operation.

An object of the present invention is therefore to provide a high efficiency waveguide mode converter apparatus.

Another object of the invention is to provide a mode converter apparatus which combines the benefits of a tapering waveguide diameter and a tapered radial fin in order to achieve high conversion efficiency and other benefits.

Another object of the invention is to provide a mode converter apparatus having circular waveguide input and output ports of functionally selected physical diameters.

Another object of the invention is to provide a waveguide mode conversion apparatus having axially displaced input and output ports.

Another object of the invention is to provide a mode converter apparatus of the aforementioned advantages which is also capable of operating at high radio frequency energy levels.

Another object of the invention is to provide a $TM_{01}$ to $TE_{11}$ circular waveguide mode conversion apparatus that is relatively simple and low in fabrication cost.

Another object of the invention is to provide a mode converter apparatus which may be advantageously employed as a coupling between a $TM_{01}$ mode source of radio frequency energy and a $TE_{11}$ mode antenna array or other load.

Additional objects and features of the invention will be understood from the following description and the accompanying drawings.

These and other objects of the invention are achieved by the method for converting microwave energy from the circular $TM_{01}$ electromagnetic wave mode to the circular $TE_{11}$ electromagnetic wave mode comprising the steps of coupling the $TM_{01}$ mode disposed microwave energy into a first circular waveguide of $TM_{01}$ mode supporting first physical cross section size; communicating said microwave energy along said first circular waveguide into an E field and B field bending region of axially tapered and radially extending waveguide wall perturbation wherein local bending of $TM_{01}$ mode E field and B field lines toward respective orthogonality and parallelism with the waveguide wall perturbation commence, said field line bending additionally comprising the generating of $TE_{178,1}$ mode energy components; continuing the communicating, field line bending, and $TE_{\frac{1}{2},1}$ mode generating along the wall perturbation axial length into a minimal energy reflection waveguide region of gradually reducing asymmetric circular cross section and increasing $TM_{01}$ mode suppression; issuing said microwave energy from said path of gradually reducing asymmetric circular cross section through an aperture of $TE_{11}$ mode supporting plus $TM_{01}$ and $TE_{\frac{1}{2},1}$ mode suppressing physical cross section to a $TE_{11}$ mode energy utilizing apparatus.

DETAILED DESCRIPTION

In the following description reference is made to various waveguide modes using the $TM_{xx}$ and $TE_{xx}$ notation in keeping with the generally accepted use of such terminology in the art. In this document such references relate, unless otherwise stated, to circular waveguide operating modes as opposed to the similar modes and notation used with the rectangular waveguides. The term TM is the notation, of course, referring to a transverse magnetic wave, and the term TE to a transverse electric wave field. In the case of $TM_{0m}$ the magnetic field is circular in nature and m is the number of cylinders including the boundary of the waveguide to which the electric vector is normal. A more complete understanding of these mode conventions is to be found in the publication "Standards on Radio Wave Propagation of Terms Related to Guided Waves" which was published by the Institute of Radio Engineers, New York, N.Y., 1945. Brief explanations of this convention are also to be found in the herein incorporated by reference text books of Terman and Southworth.

Figure 1:
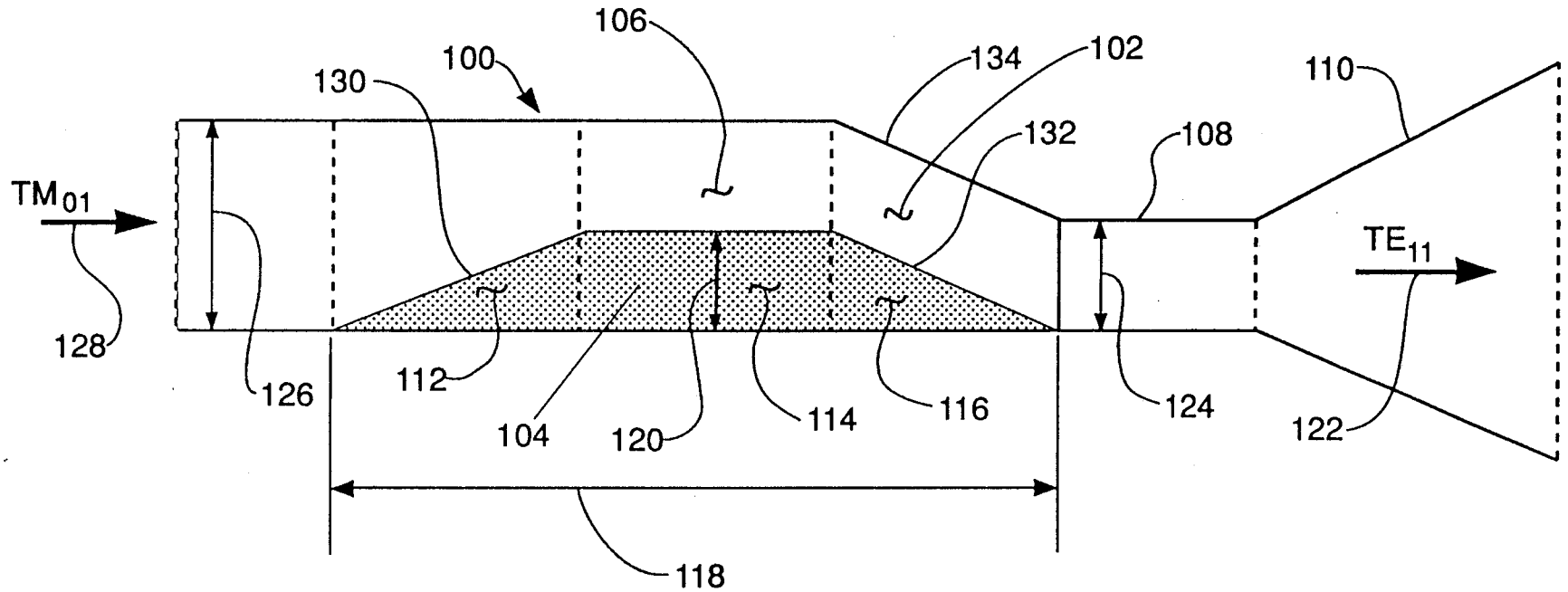
FIG. 1 shows a side cross sectional representation of a mode converter and its loading antenna in accordance with the invention.

FIG. 1 in the drawings therefore shows a cross sectional representation of a circular waveguide mode converter apparatus 100 that is made in accordance with the present invention. The mode converter 100 in FIG. 1 is shown to include an asymmetrically shaped conical frustum tapered waveguide section 102, a cylindrically shaped input and mode transition region waveguide section 106 and a tapered radially disposed fin member 104 as major components thereof. Coupled to the output of the conical frustum waveguide section 102 is a load apparatus having the form of a horn antenna 110 and a mode converter to antenna coupling circular waveguide section 108. The coupling waveguide section 108 has a diameter 124 which is the same as the output port diameter of the waveguide section 102 as is described in more detail below.

In a similar manner the diameter of the transition waveguide section 106 is indicated at 126 in FIG. 1. The fin member 104 in FIG. 1 is shown to include a sloping or ramped input section 112; this section may also be considered to be of a radially varying nature, as indicated at 130, with respect to the input waveguide section 106 as is also suggested by the ramp at 112 in FIG. 1. In a similar manner the fin output section 116 is shown to have a radially varying or sloped nature as is indicated at 132 in FIG. 1.

The length of the fin member 104 is indicated at 118 in FIG. 1 this overall length is preferably in the order of 3.65 times the free space wavelength of the mid band radio frequency energy signal coupled to the FIG. 1 mode converter. The height or radial dimension of the fin member 104 is indicated at 120 in FIG. 1 this height being preferably on the order of one half of the diameter 126 of the input waveguide section or between 0.9 and 1.1 times the radius of the waveguide, for example.

The radio frequency energy output of the FIG. 1 converter is indicated by the arrow 122. This energy is disposed in the $TE_{11}$ mode in the case of the herein to be described $TM_{01}$ to $TE_{11}$ mode converter. The $TM_{01}$ mode input radio frequency energy for the FIG. 1 converter apparatus is indicated at 128 in FIG. 1.

Before embarking on a discussion of the technical aspects of the FIG. 1 mode converter it is helpful to consider that converters of the type shown in FIG. 1 may be tailored for a number of different microwave operating frequency bands with the overall dimensions of the converter varying in response to the selected operating band. For operation in the 1.3 gigahertz or "L" band of the radio frequency spectrum, as is often used in long range search radars for example, the diameter 126 in FIG. 1 may be in the order of 13.5 inches and the overall length 118 in the range of 0.8 meters. In comparison with several previously used mode conversion arrangements this length is a notable improvement.

In view of the current interest in high energy microwave devices for use as weapons, relatively small and efficient converters of the FIG. 1 type are also desirable additions to the microwave plumbing tools since these weapons usually require the use of an antenna and are most conveniently arranged to provide maximum energy coupling in the center of the antenna field. The below described arrangement of the FIG. 1 converter when fabricated of materials which provide low field emission, materials such as stainless steel or aluminum having a have high field emission threshold enables vacuum operation at pulsed power levels in the range of 500 megawatts or $5\times10^8$ watts for 150 nanosecond pulses at the 1.3 gigahertz operating frequency. With rounding or enlargement of the fin corners as described below even higher power levels may be achievable.

Figure 4:
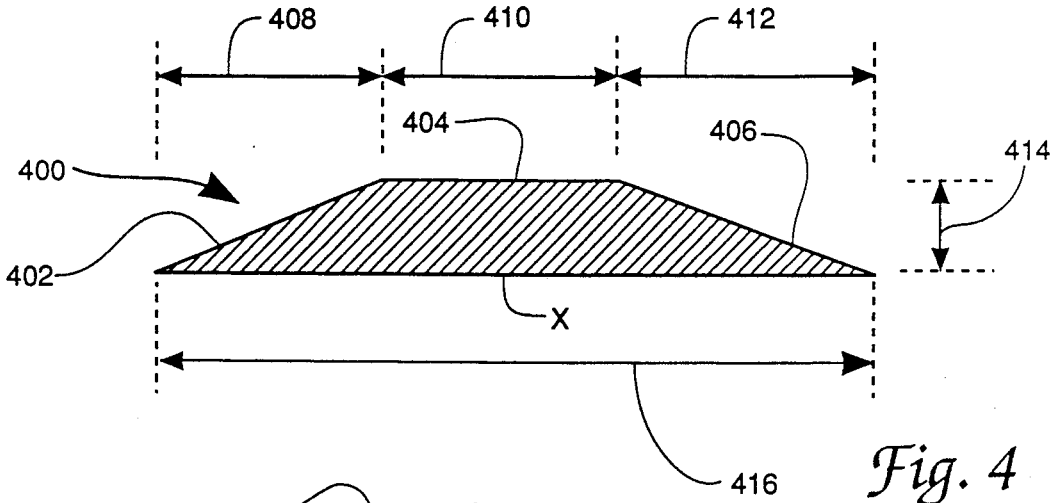
FIG. 4 shows a side view of the radial fin member usable in the FIG. 2 and FIG. 3 apparatus.

The FIG. 1 mode converter device converts the incident $TM_{01}$ mode energy 128 to a $TE_{11}$ mode form 122 by means of a carefully chosen gradual change in the waveguide cross-sectional geometry. This change is achieved through combined use of the asymmetric cone 102 and the radial fin 104. A cross-sectional view of the hybrid $TE_{\frac{1}{2},1}$ mode which is characteristic of the finned circular guide 100 is shown in FIG. 4.25 of the additional and hereby incorporated by reference book "Field and Wave Electrodynamics" by C. C. Johnson, McGraw Hill 1965. Conversion of the incident $TM_{01}$ mode energy to a hybrid $TE_{\frac{1}{2},1}$ mode form is in fact the first half of the FIG. 1 apparatus accomplished overall process of conversion from $TM_{01}$ to $TE_{11}$ modes. Final conversion of the hybrid $TE_{\frac{1}{2},1}$ mode to the circular $TE_{11}$ mode is performed by the finned asymmetric cone section, 104 in the FIG. 1 apparatus with the fin gradually tapering away as shown at 132 in FIG. 1.

Although techniques for analyzing and quantifying waveguide mode conversion processes have existed for some time, (see for example, L. Solymar, "Spurious Mode Generation in Nonuniform Waveguide," which appears in the IRE Transactions on Microwave Theory and Techniques, July 1959, p 379–383), the invention described here is difficult to analyze theoretically in a quantitative manner because of is asymmetric geometry. A plurality of qualitative description topics together with verification results are nevertheless presented herein.

To qualitatively appreciate the operation of the FIG. 1 apparatus it may be noted that electromagnetic fields in the apparatus are constrained to conform to Maxwell's equations and to the boundary conditions imposed on the fields at the waveguide walls. These constraints further imply that:

1. E, the electric field, at a conductor is perpendicular to the conducting surface, and the component of E parallel to the wall is zero.
2. B, the magnetic field, at a conductor is parallel to the conducting surface and the component of B perpendicular to the wall is zero.
3. The E and B fields within the FIG. 1 apparatus are everywhere mutually perpendicular and the orientation of E may be inferred from B and vice-versa.

As a consequence of these three conditions a nonzero amount of mode conversion from $TM_{01}$ to $TE_{11}$ will occur if any nonsymmetric conducting perturbation is placed against the interior wall of a $TM_{01}$ wave carrying guide. Such a perturbation tends to bend E field lines to become normal to the perturbation in its vicinity, and cause the B field lines to become parallel to it in its vicinity and thereby break the axisymmetric characteristic of the forward traveling $TM_{01}$ wave. The resulting deformation of the E and B field lines therefore produces a field configuration which has a nonzero $TE_{11}$ component. The real challenge in fact does not lie in the conversion of merely some incident $TM_{01}$ mode energy to $TE_{11}$ but rather in performance of the mode conversion with high efficiency and over a broad frequency band.

Another qualitative view of the mode conversion process is possible through representation of the wavefields as a superposition of plane wave components reflecting from the waveguide conducting surfaces as they propagate along the guide. For a guide of infinite translational symmetry along the direction of energy flow, this representation of waveguide transmission may be applied rigorously and quantitatively as described in the above incorporated by reference text of George C. Southworth "Principles and Applications of Waveguide Transmission" at Page 168–169.

As represented in Southworth's FIG. 9, wave reflections may be decomposed into two components: polarization (i.e., direction of E) perpendicular to the plane of incidence as in FIG. 9A, and polarization parallel to the plane of incidence as in FIG. 9B. Reflections shown in FIG. 9A are characteristic of TE waves, while those in FIG. 9B are characteristic of TM waves. In particular waves representative of the incident $TM_{01}$ mode are polarized parallel to the local plane of incidence as they reflect off the walls in propagating along the initial waveguide. In the converter section 106 in FIG. 1 however, the incident waves encounter reflecting surfaces that are not generally parallel to the planes of their previous reflections. As a result, these reflections represent superpositions of the processes in FIG. 9A and 9B, implying that the incident TM waves acquire a TE component upon reflections from the mode converter surface.

Other considerations which contribute to the arrangement of the invention shown in FIG. 1 include:

1. To minimize reflections which decrease efficiency, the forward wave should encounter only gradual perturbations in the waveguide boundaries;
2. Use with very high power sources requires that perturbations not cause unacceptable high electric field enhancement, which could lead to failure or degradation of performance due to field emission;
3. A compact, in-line design is preferable to overcome geometry disadvantages of alternate mode converters;
4. The waveguide perturbations employed to produce mode conversion should not rely on resonant effects—to allow for broadband operation of the mode converter;
5. The ratio of the mode converter input to output waveguide diameters should maximize operating bandwidth and cutoff residual $TM_{01}$ wave mode and other higher than $TE_{11}$ mode components.

The diameter ratio requirement last listed above may be addressed through the following consideration. The $TE_{11}$ mode is the dominant mode of a circular waveguide, i.e., the $TE_{11}$ mode has the lowest cutoff frequency of any possible mode in a circular waveguide. Thus a $TE_{11}$ mode will propagate in a narrower diameter guide than a $TM_{01}$ mode. This fact is used to advantage in the present apparatus, since the reduction in waveguide radius from the $TM_{01}$ entrance to the $TE_{11}$ exit suppresses the transmission of any unconverted incident $TM_{01}$ component and also enables determination of a bound to the ratio of input to output waveguide diameters imposed by the criteria that bandwidth be maximized.

The ten lowest circular waveguide cutoff frequencies, normalized to the $TE_{11}$ mode, are given in Table 1 below (for reference, also see the above incorporated Curtis C. Johnson, text "Field and Wave Electrodynamics," chapter 4). Since propagation can only occur for frequencies above the cutoff value, in order to totally cutoff all modes except $TE_{11}$ in the output waveguide, the mode converter must operate across a band no wider than values for $f_{high/Flow}=1.3061$ to 1. Comparing this to the mid-frequency, 1.1531 (i.e. the numerical average of 1.3061 and 1,000), this restriction imposes that the maximum bandwidth $BW_{max}=(1.3061-1.0000)/1.1531$, or 26.55%. The useful bandwidth may actually be increased in practice, since testing shows that only a small amount of the incident $TM_{01}$ mode propagates to the output even at frequencies somewhat exceeding the $TM_{01}$ cutoff frequency in the output guide.

TABLE 1

Circular Waveguide Cutoff Frequencies Relative to $TE_{11}$ Mode

| MODE | Cutoff Frequency Relative to TE11 |
|---|---|
| $TE_{11}$ | 1.0000 |
| $TM_{01}$ | 1.3061 |
| $TE_{21}$ | 1.6589 |
| $TE_{01}$ | 2.0811 |
| $TM_{11}$ | 2.0811 |
| $TE_{31}$ | 2.2818 |
| $TM_{21}$ | 2.7893 |
| $TE_{41}$ | 2.8881 |
| $TE_{12}$ | 2.8957 |
| $TM_{02}$ | 2.9981 |

In principle, a cylindrically symmetric VCO energy source can only generate $TM_{0n}$ modes. Thus its useful $TM_{01}$ operating range can conceivably extend up to the next $TM_{0n}$ cutoff frequency or to the $TM_{02}$ cutoff frequency. If it is rigorously required that any $TM_{01}$ mode propagating in the input guide at a frequency less than the $TM_{02}$ cutoff frequency be unable to propagate as a $TM_{01}$ mode in the output guide, then the ratio of input to output diameters, $d_{in}/d_{out}$ must be greater than or equal to $2.9981/1.3601=2.2955$ to 1. This consequently restricts the operating range of the system to be between 2.2955/1.3061 or 1.7575 and 2.2955 times the $TM_{01}$ cutoff frequency in the input waveguide.

In the case of the present invention mode converters when used with a VCO however, it has been noted experimentally that a VCO tends to operate in the highest $TM_{0n}$ mode that is not cutoff (see D. J. Sullivan et al., "Virtual Cathode Oscillator Theory," Chap. 13 of "High Power Microwave Sources" ed. by V. L. Granatstein and I. Alexeff, Artech House, Boston, Mass., c1987). Thus, to ensure proper operation of a VCO in a $TM_{01}$ mode it is desirable to allow a "safety factor" by designing the VCO for operation in a smaller frequency range that does not extend all the way up to the $TM_{02}$ cutoff. This in turn relaxes the restriction on diameter ratio, allowing $d_{in}/d_{out}$ to be somewhat less than 2.2955. This is advantageous, since the use of a larger diameter output guide increases power handling capability. A $d_{in}/d_{out}$ ratio of about 2.14 to 1 has been found desirable in this regard for the FIG. 1 apparatus.

Figure 2:
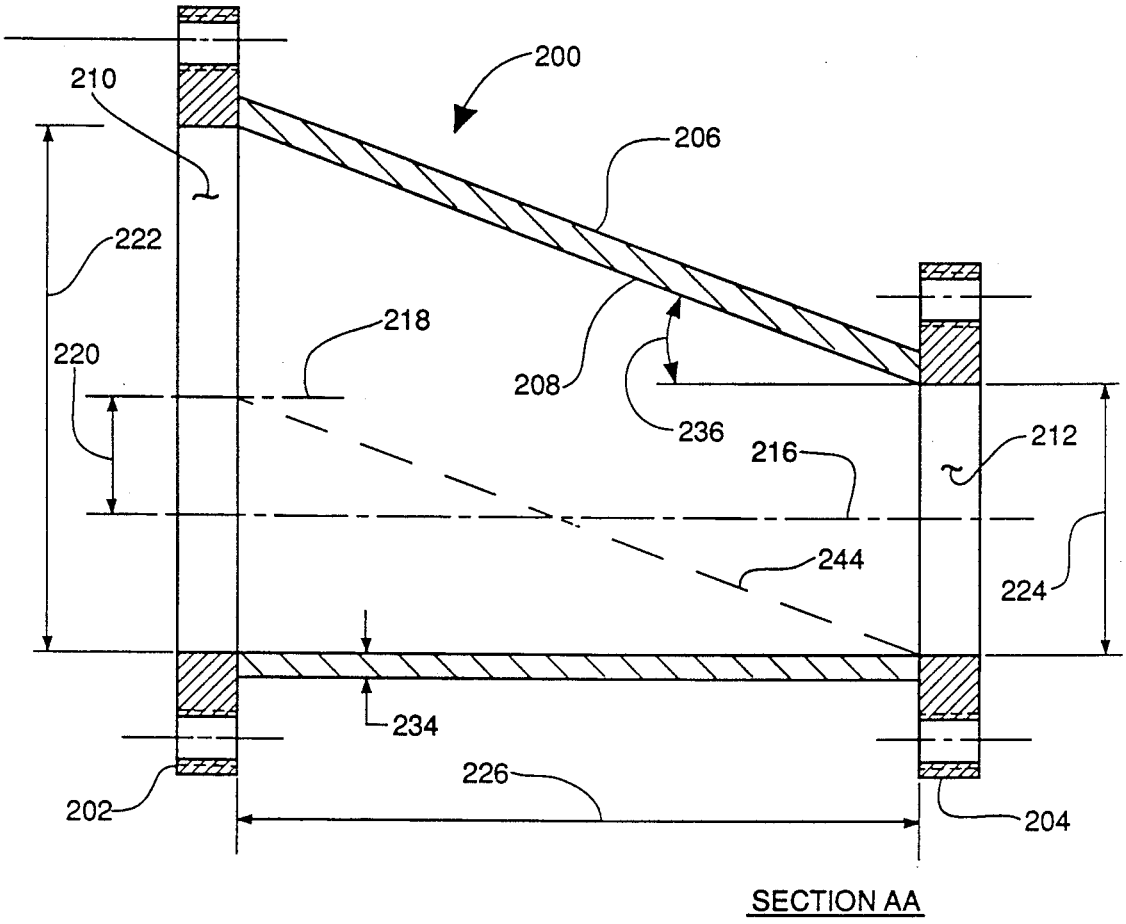
FIG. 2 shows a side cross sectional view of a conical frustum tapering waveguide section in accordance with the invention.
Figure 3:
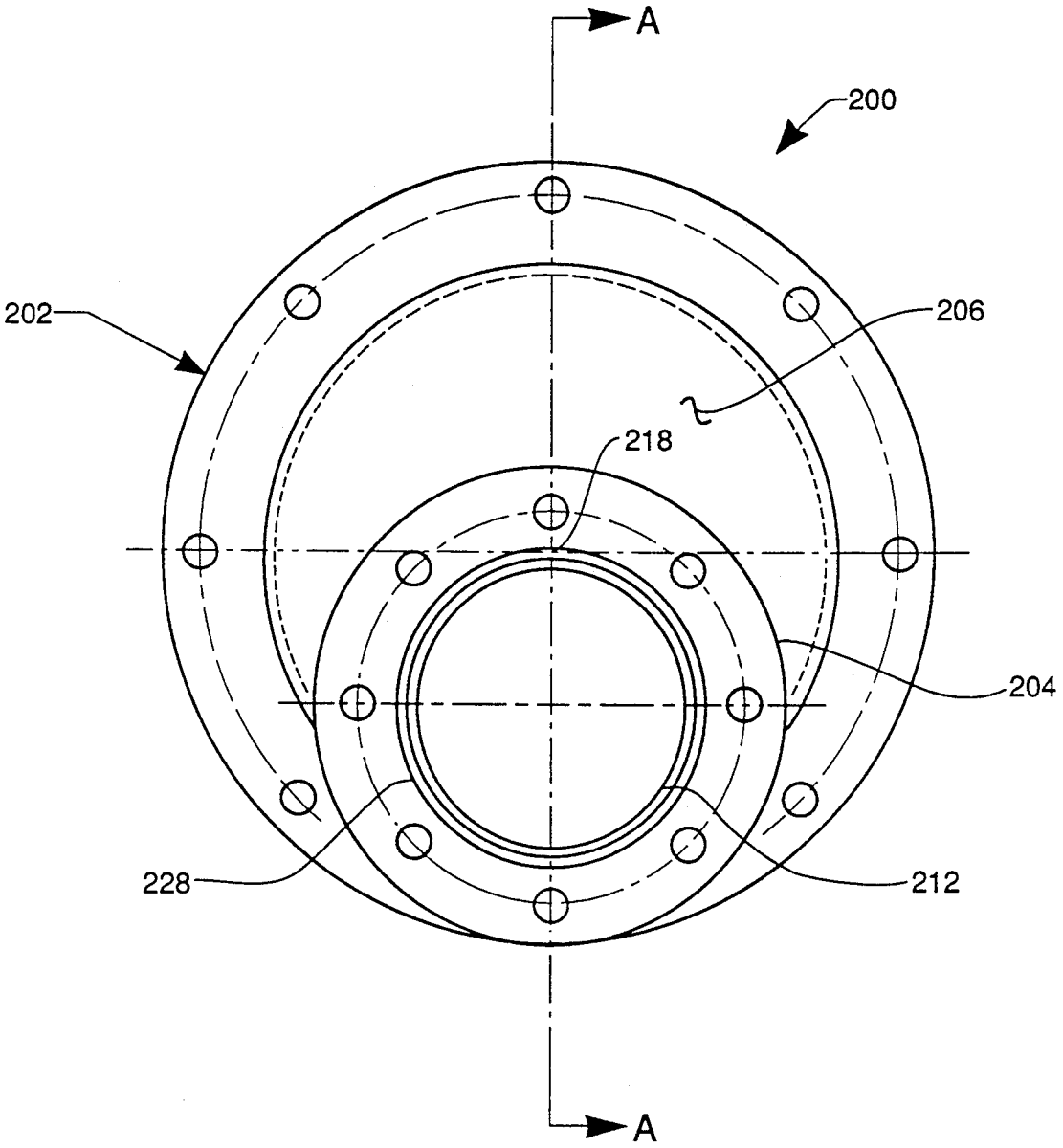
FIG. 3 shows a right-hand end view of the conical frustum section in FIG. 2.

FIGS. 2 and 3 in the drawings show details of a functional embodiment conical frustum waveguide section of the type shown at 102 in FIG. 1, including detailed information concerning the mounting flanges and the fabrication techniques which may be employed therewith.

FIG. 3 of these drawings shows an end view of the asymmetrically shaPed conical frustum waveguide section while FIG. 2 shows a cross sectional view of this same structure and is a view taken along the cutting line A—A in FIG. 3. In view of this relationship between FIG. 2 and 3, identification numbers used in these figures are identical and in the 200 series of numbers for features appearing first in FIG. 2. The waveguide section 200 appearing in FIG. 2 and FIG. 3 therefore includes a pair of mounting flanges 202 and 204 which are connected by the asymmetric conical frustum body portion 206. The body portion 206 is asymmetric in the sense of the input port of the waveguide, that is the port of the aperture 210, being centered on a first axis 218 and the output port, the port at the aperture 212 being centered on a second axis 216 with the first and second axes 218 and 216 being displaced from each other by the distance 220.

Several additional details of the conical frustum waveguide section are also shown in the FIG. 2 and FIG. 3 drawings, these details include the diameter of the input Port aperture 210, this diameter being indicated at 222 in FIG. 2; and the conical section length, which is indicated at 226, and is preferably made approximately equal to the diameter 222 notwithstanding the different relationship suggested in the FIG. 1 drawing. Also shown in FIG. 2 and FIG. 3 are the diameter of the output port aperture 224, the thickness of the conical section material indicated at 234, and the maximum angle between the sloping conical surface 208 and the axes 216 and 218, this angle is indicated at 236 in FIG. 2 and preferably has a size of about 28 degrees and 17 minutes in the described embodiment of the invention.

As indicated previously herein one of the more significant aspects of the FIG. 2 and 3 conical frustum waveguide section is concerned with the gradual change in cross sectional geometry encountered as the microwave energy propagates from left to right in the FIG. 2 waveguide. The minimizing of loss increasing reflections in this gradual change of geometry is one significant consequence of its use. The combination of this gradual change in cross sectional geometry and the output taper of the radial fin which is preferably disposed as indicated by the tapes 244 in the waveguide of FIG. 2, is found in fact to provide operating efficiency in the range of 75% with a bandwidth of about 30% for the present invention mode converter.

As is indicated by the leftward most end of the output fin taper 244, the upward most surface of the fin in the central section of FIG. 1 is preferably made coincident with the axis or center of the aperture 210 in FIG. 2. The upward surface of the fin taper 244 and the maximally sloping portion of the conical frustum, the surface 208, are substantially parallel in this arrangement. The term maximally sloping is used herein in recognition of the change in slope angle around the circumference of the FIG. 2 frustum to a slope of zero along the straight portion of the frustum at the bottom most part of FIG. 2.

An extension of the output fin taper 244 beyond the flange 204 or termination of the fin taper 244 significantly ahead of the flange 204 are each modifications which have been found to decrease the conversion efficiency of the FIG. 1 mode converter. The achievement of optimum conversion efficiency is in fact found to occur when the fin taper angle and cone taper angle, that is the slopes of the surface 208 and the taper 244 in FIG. 2, are closely matched. This closely matched arrangement of angles appears to yield the most gradual transition from the mode converter into the antenna or filter element, or other apparatus which may be connected to the flange 204.

In addition to this close matching of angles, it is found desirable to have the fin taper 244 and the surface 208 be in somewhat close proximity in order to achieve high mode conversion efficiency. The desirability of this close proximity precludes locating the fin 104 prior to the tapered cone section 102, for example.

Although the asymmetric shape of the FIG. 2 and FIG. 3 mode converter significantly complicates the application of theoretical analysis to the conversion function it is believed that analysis based upon finite difference algorithms embodied in electromagnetic modeling computer programs that are available commercially and related techniques may be possible and enable theoretical optimization of the converter design Additionally, The article "Spurious Mode Generation in Non Uniform Waveguide" published by the Institute of Radio Engineers (IRE) in Transactions on Microwave Theory Technology, volume MTT-7 page 379–383 in July of 1959 discloses the theory for propagation of fields through a nonuniform waveguide connecting two uniform waveguides. A complete theoretical design of a fin only type of converter may be accomplished in accordance with the principles of this article with the following steps.

1. Compute lowest order TE and TM propagation constants and a complete set of coupling coefficients (i.e., forward TE to forward TM, forward IE to backward TM, etc.) as a function of t for fixed radius, where t= radial height of the fin.
2. Select a candidate t-profile and radial taper for the converter.
3. Use Solymar's technique as described in the IRE article to compute the S-matrix for the converter, relating incident TM, and TE modes to the outgoing TE mode.
4. Iterate steps 2 and 3 to determine optimum t-profile and radial taper.

Modifications of this step sequence to accommodate the present tapered fin plus asymmetric cone mode converter can be accomplished.

The FIG. 2 illustrated relationship between the surface 208 and the taper 244 is also desirable for avoiding electrical breakdown in the waveguide. Arrangements wherein these elements come into closer proximity would of course be subject to such electrical breakdown and effectively limit the operating power level of the waveguide.

In the interest of avoiding electrical breakdown in the waveguide it is also desirable to fabricate the conical section of FIGS. 2 and 3 from high field emission threshold materials, such as the aluminum and stainless steel indicated above, and to cover the fin top surface and corners with a rounded rail or other electrical stress reducing cross sectional shape. The benefit of such controlled rounding cross sectional shape may be appreciated from calculations indicating that a fin tip of radius one twentieth (1/20) of the waveguide cylinder radius is associated with an electric field enhancement which is of approximately 1.49 times. Since smaller radii provide greater enhancement and larger radii smaller enhancement, this 1.49 value is to be compared to a significantly larger enhancement expected from a sharp corner fin upper shape. The mathematical relationship $E(d)/E_{av}=0.333/(d/a)^{\frac{1}{2}}$ (which is valid for $d<<a$) predicts the electric field E(d) at the surface of a rounded fin tip from the average of the field radial component $E_{av}$ over the fin radius d and the waveguide radius a.

FIG. 4 in the drawings shows details of the fin member 104 in FIG. 1. These details include an overall length indicated at 416, which is approximately 3.65 times the free space wave length, $\lambda_f$, of the received center frequency energy, the height, indicated at 414, which is preferably on the order 0.7 $\lambda_f$, and the ramped input section 402 length indicated at 408 which has a dimension of 1.04$\lambda_f$. Also shown in FIG. 4 are the length dimension 410 for the central fin section 404, a length of 1.14 $\lambda_f$, and the length 412 of the ramped output section 406, a length of 1.47$\lambda_f$. The fin 400 in FIG. 4 preferably is fabricated of sheet metal (as indicated by the shading pattern) of sufficient thickness to be rigid and may be of the same composition as the waveguide section described above.

Figure 5:
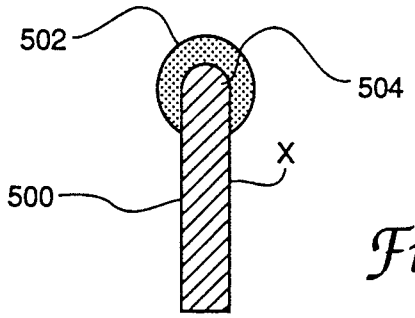
FIG. 5 shows an end view of the FIG. 4 radial fin.

An optional fin arrangement and extreme case electrical stress decreasing fin rounding is shown in FIG. 5 of the drawings. In FIG. 5 the fin 500 is provided with both its own normally rounded upper surface as indicated at 504 and is additionally provided with an overlaying bead member 502 which has an even larger radius——to lower the electrical stress attending the fin upper cross sectional region. The bead 502 in FIG. 5 may be fabricated from any low emission metal, such as molybdenum stainless steel, or aluminum.

ALTERNATIVE ARRANGEMENTS

An alternative arrangement for the described embodiment of the invention can be achieved through use of the asymmetric cone without the fin being present. The single-pass $TM_{01}$ to $TE_{11}$ conversion efficiency for such an asymmetric cone alone is found experimentally to be about 25% compared to over 70% for the desired finned and asymmetric cone combination. Although relatively low in efficiency, the asymmetric cone without fin may yet be useful as a mode converter with extremely high power microwave sources——sources which cause electric field enhancements in the upper or salient region of the fin to reach the level where field emission becomes a problem despite the presence of a rounded bead at the salient edge of the fin. Since the electric field strength in a waveguide is proportional to the square root of the power, the mere doubling of the maximum field strength that the converter can withstand enables a 4 times increase in power handling capability. No field emission problems are noted during operation of the herein described embodiment of the finned asymmetric cone at incident power levels in the range of 500 MW ($5\times10^8$ W) for 150 nanosecond pulses at 1.3GHz. Notwithstanding this power level, it is not found necessary to use the rounded bead 502 at the fin top, since a simple ⅛th inch radius 504 along the stainless steel fin edge proves to be sufficient.

Use of the asymmetric cone alone in a mode converter therefore results in:

1. Significantly higher power handling capability (an advantage)
2. More compact converter size (an advantage)
3. Substantially lower efficiency (a disadvantage)

In another alternate arrangement of the invention, a tapered fin may be used with a conventional cylindrical waveguide section. Mode conversion in this type of converter will however occur with substantially less efficiency.

When used as a $TM_{0n}$ to $TE_{11}$ converter, $TM_{0n}$ modes with $n>1$ may be converted to $TE_{11}$ modes by a modified use of the finned asymmetric cone converter, although this conversion will occur substantially less efficiently. Such converter apparatus is possible because higher order ($n>1$) $TM_{0n}$ modes are equivalent in field configuration to a $TM_{01}$ mode over a region of space extending from the waveguide center where $r=0$, to a radius $r_{conv}< r_{guide}$ which depends on the order (n) of the mode. Specifically, for such a converter the mode converter input port radius, $r_{conv}$ is made to have a value equal to the location where $TM_{0n}$ mode has its first equipotential cylindrical surface, that is $r_{conv}=r_{guide}$ $P_{01}/P_{0n}$, where $P_{01}$ is the first zero of the $J_0$ Bessel function, and $P_{0n}$ is the nth zero of the $J_0$ Bessel function. In this use, the finned asymmetric cone mode converter described earlier, with input port radius $r_{conv}$ is placed concentrically within the larger circular $TM_{0n}$ carrying guide. In this location it collects the interior $TM_{01}$ part (as referenced to the input of the converter section) of the original incident forward-traveling $TM_{0n}$ wave. The overall $TM_{0n}$ to $TE_{11}$ mode conversion efficiency using this technique may be estimated by computing the fraction of the total forward power in the $TM_{0n}$ mode which is collectible as $TM_{01}$ mode energy. This fraction decreases as n increases. For conversion of the $TM_{02}$ mode to $TE_{11}$, approximately 44% of the $TM_{02}$ power is available (i.e., is carried in the space $r< r_{guide} P_{01}/P_{02}$) for collection as a $TM_{01}$ mode. If this is followed by conversion to $TE_{11}$ at an efficiency of 70% then the combined $TM_{02}$ to $TE_{11}$ conversion efficiency will be (0.44) (0.70), or about 31%. Conversion with this efficiency may be useful in some applications. For $TM_{03}$ to $TE_{11}$ conversion, the overall efficiency falls to about 20%.

In yet another alternate mode converter arrangement a tapered fin may be combined with a conventional symmetric cone mode filter. An arrangement of this type is however less efficient than even the asymmetric cone alone and in fact achieved an efficiency level of less than twenty percent. A tapered fin plus symmetric cone converter also does not have the high power handling capability of the asymmetric cone alone, however it does offer the advantage of extreme simplicity of construction. The tapered fin plus symmetric cone converter may therefore be useful in research projects and in situations where efficiency and compactness are less important than cost and ease of construction.

ADVANTAGES

The preferred FIG. 1–3 arrangement of the invention has several advantages over previously used mode conversion arrangements. In particular, none of the earlier mode conversion apparatus has an equivalent combination of high efficiency and broadband operation together with a compact in-line package. Such a consideration is important in the performance of high power microwave (HPM) susceptibility testing and is critical in practical HPM weapon design. Use of the asymmetric cone herein described is especially desirable in these converters and is a new feature in the waveguide art. In addition, although finned transmission lines have been utilized for their broadband characteristics in prior apparatus, they have not found application in $TM_{01}$ to $TE_{11}$ mode conversion setting.

The described arrangement of the invention therefore has the following advantageous characteristics:

1. High efficiency (70% or better single-pass efficiency) in conversion of power from circular $TM_{01}$ to circular $TE_{11}$ modes;

2. Compact design (size scales with wavelength with overall length being about $3.65 \times \lambda_{free}$)
3. Operation over a broadband of frequencies (25% of the center design operating frequency) resonance of component elements is expressly avoided;
4. Capability for very high power operation.
5. Produces pencil beam radiation directly from a conical horn aligned with the source.
6. Of straightforward construction, by means of roll up and weld techniques.

Figure 6:
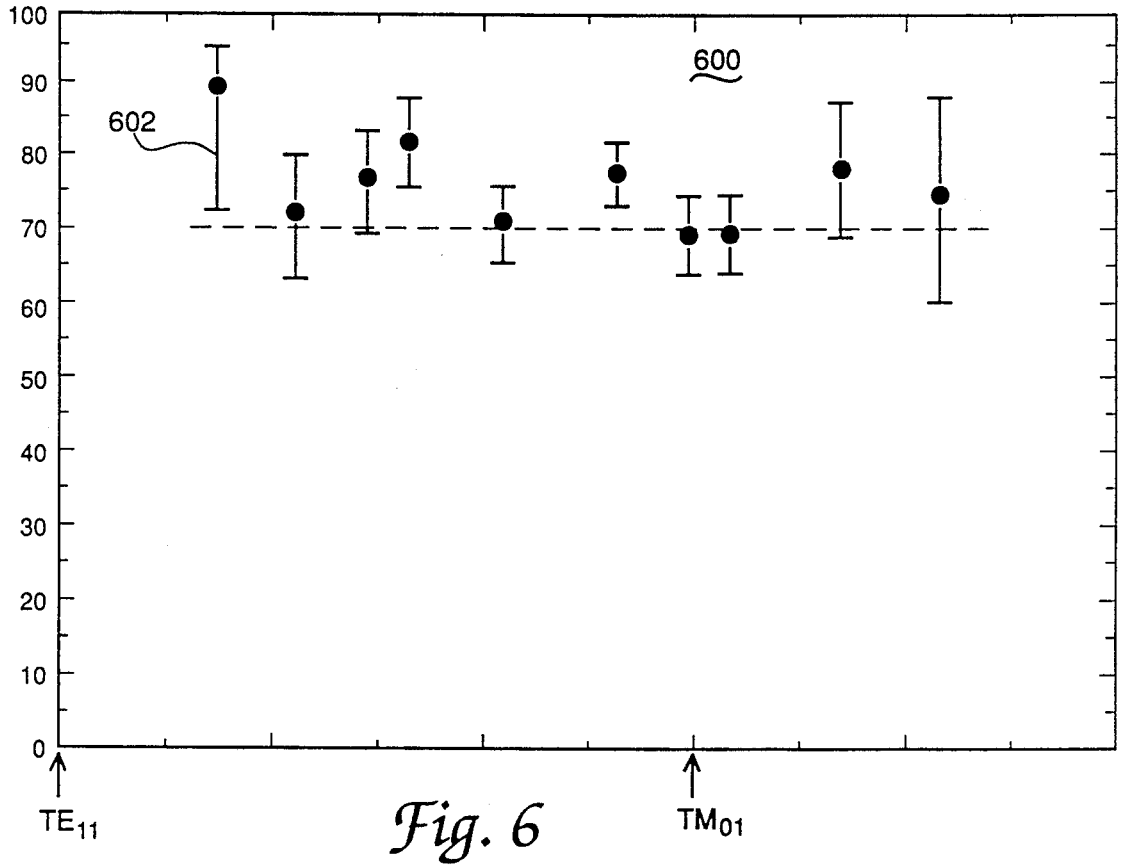
FIG. 6 shows the variation of mode conversion efficiency in an embodiment of the FIG. 1 converter.

Single-pass conversion efficiency for the finned asymmetric cone converter in fact exceeds 70% over a 25% frequency bandwidth, as is shown in the data 600 in FIG. 6 of the drawings. It is to be noted that the mode converter effectively converts incident $TM_{01}$ mode energy even though at some of the frequencies tested, the incident $Tm_{01}$ waves are above the $TM_{01}$ cutoff in the output guide, and near the $TM_{02}$ cutoff in the input guide. Measurements during such operation, (i.e. near the input $TM_{01}$ or $TM_{02}$ cutoff frequencies), are somewhat difficult to perform with great accuracy for single pass conditions due to the influence of varying frequency responses of the waveguide launching and receiving antennas. The larger error bars 602 shown in FIG. 6 for each of the measurements near these frequencies are a consequence of this occurrence.

While the apparatus and method herein described constitute a preferred embodiment of the invention, it is to be understood that the invention is not limited to this precise form of apparatus or method and that changes may be made therein without departing from the scope of the invention which is defined in the appended claims.

We claim:

1. Circular waveguide broadband microwave $TM_{01}$ to $TE_{11}$ mode converter apparatus comprising the combination of:

means including an axis centered right circular cylinder shaped first waveguide section of first circle physical diameter for receiving $TM_{01}$ mode microwave energy from a source thereof;

means including a tapering bodied asymmetric conical frustum shaped second waveguide section of said first circle base diameter and axis centering, at a said first waveguide section connected input end thereof, and of a smaller second circle base diameter and base displacement from said axis centering at the load connected output end thereof, for converting input end received $TM_{01}$ mode electromagnetic wave energy through an intermediate mode to output end issued $TE_{11}$ mode electromagnetic wave energy.

2. The mode converter apparatus of claim 1 further comprising means including an electrically conductive perturbation member disposed adjacent an interior surface of at least one of said waveguide sections.

3. The mode converter apparatus of claim 2 wherein said perturbation member comprises a radially disposed fin member.

4. The mode converter apparatus of claim 3 wherein said radially disposed fin member is lengthwise disposed within said second waveguide section and transverse of a connection between said first and second waveguide sections.

5. The mode converter apparatus of claim 4 wherein said fin member includes ramped leading and trailing edge portions in the directions of said input and output ends respectively.

6. The mode converter apparatus of claim 5 wherein the slope of said fin member ramped trailing edge and the maximum slope of said tapering bodied conical frustum second waveguide section with respect to said axis are substantially the same.

7. The mode converter apparatus of claim 6 wherein said fin member comprises orthogonally disposed planar surfaces connected by rounded corner surfaces of predetermined electrical stress limiting radius.

8. The mode converter apparatus of claim 7 wherein said fin member comprises nonresonant physical dimensions with respect to the frequency of said microwave energy.

9. The mode converter apparatus of claim 3 wherein said first physical diameter is responsive to said $TM_{01}$ mode input energy and said output end smaller second diameter is selected to pass said $TE_{11}$ mode energy and suppress said $TM_{01}$ mode energy.

10. The mode conversion apparatus of claim 9 wherein said second diameter is greater than 1/2.2955 times said first circle physical diameter.

11. The mode converter apparatus of claim 10 wherein said tapering bodied conical frustum shaped second waveguide section has a length equal to said first circle physical diameter and wherein said second diameter thereof is substantially 1/2.14 times said first circle physical diameter.

12. The mode converter apparatus of claim 6 wherein said fin member has a radially disposed height of 0.7 $\lambda_f$ and an overall length of 3.65 $\lambda_f$ with said leading edge ramp portion having, a length of 1.04 $\lambda_f$, said trailing edge ramp portion a length of 1.47 $\lambda_f$, and the intervening fin body portion a length of 1.14 $\lambda_f$ where $\lambda_f$ is the free space wavelength of the midband input microwave energy.

13. The mode converter apparatus of claim 6 wherein said fin member ramped trailing edge portion is lengthwise received in said second waveguide section and said ramped leading edge portion and an intervening fin body portion are received in said right circular cylinder shaped first waveguide section.

14. The mode converter apparatus of claim 6 wherein said fin member is lengthwise disposed entirely within said first and second waveguide sections with said ramped trailing edge portion thereof merging into the sidewall of said asymmetric conical frustum waveguide section proximate said output end thereof.

15. The method for converting microwave energy from circular $TM_{01}$ electromagnetic wave mode disposition to circular $TE_{11}$ electromagnetic wave mode disposition comprising the steps of:

coupling the $TM_{01}$ mode disposed microwave energy into a first circular waveguide of $TM_{01}$ mode supporting first physical cross section size;

communicating said microwave energy along said first circular waveguide into an E field and B field bending region of axially tapered and radially extending waveguide wall perturbation wherein local bending of $TM_{01}$ mode E field and B field lines toward respective orthogonality and parallelism with the waveguide wall perturbation commence, said field line bending additionally comprising the generating of $TE_{\frac{1}{2},1}$ mode energy components;

continuing the communicating, field line bending, and $TE_{\frac{1}{2},1}$ mode generating along the wall perturbation axial length into a minimal energy reflection waveguide region of gradually reducing asymmetric circular cross section and increasing $TM_{01}$ mode suppression;

issuing said microwave energy from said waveguide region of gradually reducing asymmetric circular cross section through an aperture of $TE_{11}$ mode supporting plug $TM_{01}$ and $TE_{\frac{1}{2},1}$ mode suppressing physical cross section to a $TE_{11}$ mode energy utilizing apparatus.

16. The method of claim 15 wherein said continuing step includes $TM_{01}$ suppressing, $TE_{\frac{1}{2},1}$ mode generating and $TE_{11}$ mode generating over a reducing cross section axial distance equalling the diameter of said $TM_{01}$ mode first circular waveguide.

17. The method of claim 15 wherein said issuing step includes communicating said $TE_{11}$ mode microwave energy through a $TM_{01}$ mode attenuating port.

18. Circular waveguide microwave $TM_{01}$ to $TE_{11}$ mode converter apparatus comprising the combination of:

a cylindrically shaped first waveguide section of $TM_{01}$ mode propagating physical diameter, said waveguide section including a $TM_{01}$ mode energy receiving input port and a $TE_{11}$ mode output port;

an E field and B field bending fin member radially received within said waveguide section along a lengthwise extending wall portion thereof between said input and output ports, said fin member comprising a height between 0.9 and 1.1 the radius of said waveguide section and including a sloped radially varying ramp portion at the energy input end thereof;

an asymmetrically tapered conical frustum second waveguide portion located at the output end of said cylindrically shaped waveguide section with a second sloped radially varying ramp portion of said fin member disposed within said conical frustum waveguide portion.

19. The mode converter apparatus of claim 18 wherein said fin member further includes a planar face portion located on three central body lateral surfaces thereof and rounded corner members intermediate disposed of and joining said planar face portions.

20. The mode converter apparatus of claim 18 wherein said conical section waveguide portion includes a circular input aperture of said first waveguide section diameter and a circular output aperture of smaller and $TE_{11}$ mode propagation supporting diameter and wherein the adjacent slope surface of said fin member output ramp portion and said tapered conical frustum second waveguide portion are substantially parallel.

* * * * *

UNITED STATES PATENT AND TRADEMARK OFFICE

CERTIFICATE OF CORRECTION

PATENT NO. : 4,999,591

DATED : March 12, 1991

INVENTOR(S) : Robert A. Koslover et al

It is certified that error appears in the above-identified patent and that said Letters Patent is hereby corrected as shown below:

Title Page;

IN THE ABSTRACT, line 2, "circuit" should be --- circular---.

Col 2, line 46, a space should appear after "$TE_{10}$".

Col 4, line 26, "$TE_{178}$ ,1" should be ---$TE_{1/2,1}$---.

Col 8, line 6, "1,000" should be ---1.000---.

Col 8, line 66, "shaPed" should be ---shaped---.

Col 9, line 18, "Port" should be ---port---.

Col 9, line 27, "218," should be ---218;---.

Col 9, line 40, "fin" should be ---fin,---.

Col 9, line 41, "tapes" should be ---taper---.

Col 10, line 16, after "design" a period should be inserted.

Col 11, line 27, after "molybdenum" a comma should be inserted.

Col 15, line 6, "plug" should be ---plus---.

Signed and Sealed this

Eighth Day of December, 1992

*Attest:*

DOUGLAS B. COMER

*Attesting Officer*

*Acting Commissioner of Patents and Trademarks*